US012245700B1

(12) United States Patent
Poindexter

(10) Patent No.: US 12,245,700 B1
(45) Date of Patent: Mar. 11, 2025

(54) UNIVERSAL BED SIDE RAIL

(71) Applicant: Lawrence Poindexter, Atlanta, GA (US)

(72) Inventor: Lawrence Poindexter, Atlanta, GA (US)

( * ) Notice: Subject to any disclaimer, the term of this patent is extended or adjusted under 35 U.S.C. 154(b) by 0 days.

(21) Appl. No.: 18/675,051

(22) Filed: May 27, 2024

(51) Int. Cl.
*A47C 21/08* (2006.01)
*A47C 17/32* (2006.01)

(52) U.S. Cl.
CPC ..... *A47C 21/08* (2013.01); *A47C 17/32* (2013.01)

(58) Field of Classification Search
CPC ..... A47C 21/08; A47C 17/32; A61G 7/0507; A61G 7/0508; A61G 7/0512; A61G 7/0513; A61G 7/0518; A61G 7/0519; A61G 7/0525
USPC ..... 5/425, 426
See application file for complete search history.

(56) References Cited

U.S. PATENT DOCUMENTS 2,594,926 A * 4/1952 Hoffman ..... A47C 21/08 5/430
2,611,909 A * 9/1952 Dillon ..... A61G 7/0507 5/426
2,722,693 A * 11/1955 Wolf ..... A47C 20/027 5/426
2,750,605 A * 6/1956 Blevins ..... A61G 7/0518 5/100
2,751,608 A * 6/1956 Lucas ..... A47C 21/08 5/426
2,763,014 A * 9/1956 Luger ..... A61G 7/0518 5/426
5,463,784 A * 11/1995 Alpern ..... A47C 21/08 5/426
5,604,942 A * 2/1997 Allevato ..... A61G 7/0519 5/428
5,640,726 A * 6/1997 Fichner-Rathus ..... A47C 21/08 5/426
6,453,490 B1 9/2002 Cardinale
7,103,928 B1 * 9/2006 Childs ..... A61G 7/0518 5/426
7,150,053 B2 12/2006 Macari
7,178,184 B2 * 2/2007 Flannery ..... A61G 7/0518 5/426
7,908,689 B2 * 3/2011 Flannery ..... A61G 7/0507 5/426
9,289,340 B2 * 3/2016 Serhan ..... A61G 7/0507
11,259,643 B1 * 3/2022 Flannery ..... A47C 21/08
11,576,498 B1 * 2/2023 Stern ..... A47C 21/026
(Continued)

FOREIGN PATENT DOCUMENTS

GB 2219201 A * 12/1989 ..... A47C 21/08

*Primary Examiner* — David R Hare
(74) *Attorney, Agent, or Firm* — Sanchelima & Associates, P.A.; Jesus Sanchelima; Christian Sanchelima

(57) ABSTRACT

An universal bed side rails includes a mattress, a bedside assembly, and a rails assembly. The bedside assembly a first bedrail and a second bedrail connected through length adjustable beams. The rails assembly has a first rail and a second rail slidably receiving the first bedrail and the second bedrail therein. The length adjustable beams are positioned under a mattress. The first rail and second rail has flaps to secure to a spring box of a mattress. The length adjustable beams have pin locks and pin holes to secure additional beams for support in different mattress size configurations.

6 Claims, 7 Drawing Sheets

(56) References Cited

U.S. PATENT DOCUMENTS

2012/0151675 A1* 6/2012 Boucquey ..... A47C 21/08
5/425

* cited by examiner

UNIVERSAL BED SIDE RAIL

BACKGROUND OF THE INVENTION

1. Field of the Invention

The present invention relates to beds and, more particularly, to an universal bed side rail that includes a bed side rail that allows to have a bed of different sizes for different mattresses.

2. Description of the Related Art

Several designs for beds have been designed in the past. None of them, however, include an universal bed side rail that has rails to adjust the bed frame to receive mattresses of different sizes.

Applicant believes that a related reference corresponds to U.S. Pat. No. 6,453,490 issued for a bed safety guard assembly that is configurable with a safety guard on both sides of a mattress, wherein the two guards are secured together with slats positions under the mattress. Applicant believes that another related reference corresponds to U.S. Pat. No. 7,150,053 issued for an universal bed side rail with side rails on opposing sides of the mattress that are secured with adjustable straps beneath the mattress. None of these references, however, teach of an universal bed side railthat has a pair of rails mounted on two opposing sides of a mattress, the rails have length adjustable beams positioned under the mattress near the head frame portion and foot frame portion of the bed.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide an universal bed side rail that has a bed with adjustable size.

It is another object of this invention to provide an universal bed side rail that has a lock to secure the bed at a predetermined size.

It is still another object of the present invention to provide an universal bed side rail that allow to use mattresses of different sizes including full bed, twin bed, and Queen bed.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
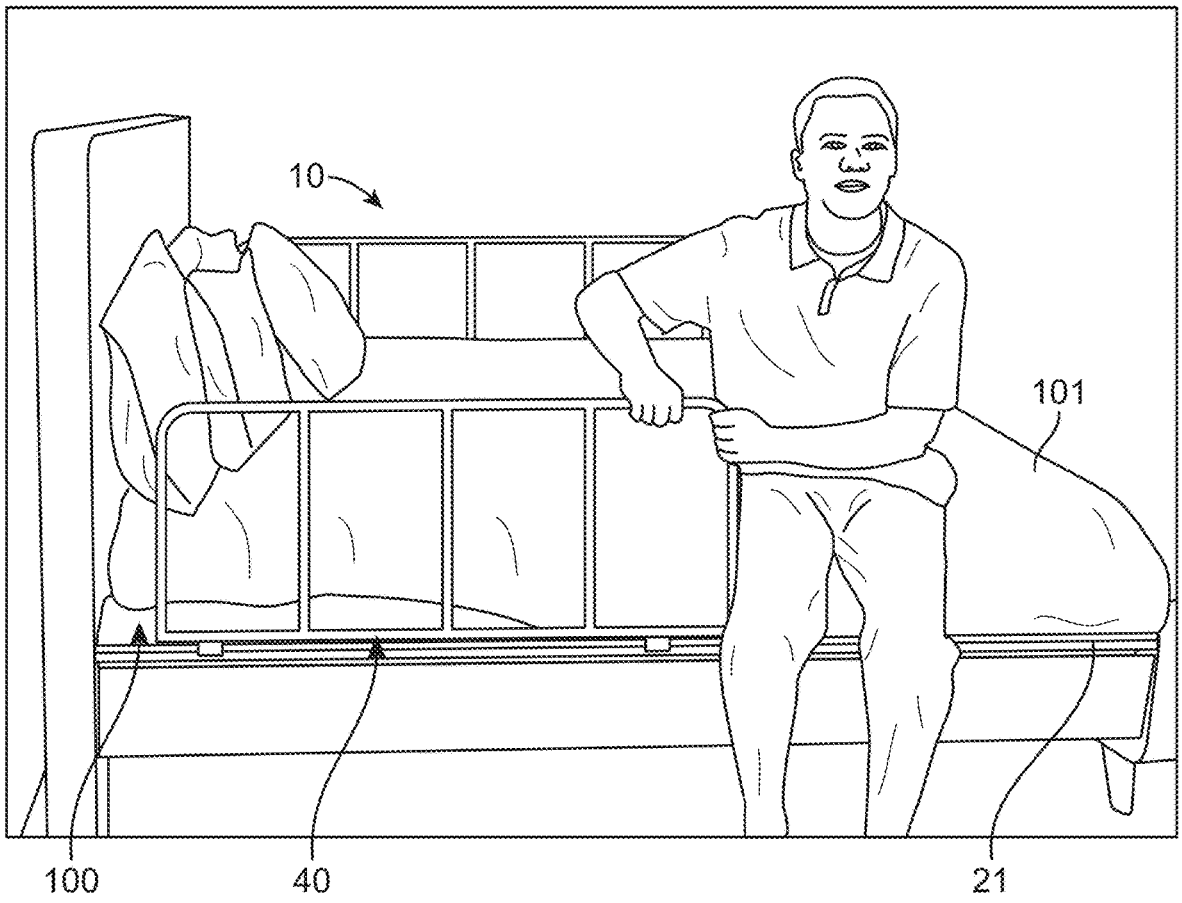
FIG. 1 represents an isometric operational view of the present invention 10 showing the bedside assembly 40 mounted on the bed box spring 100.
Figure 2:
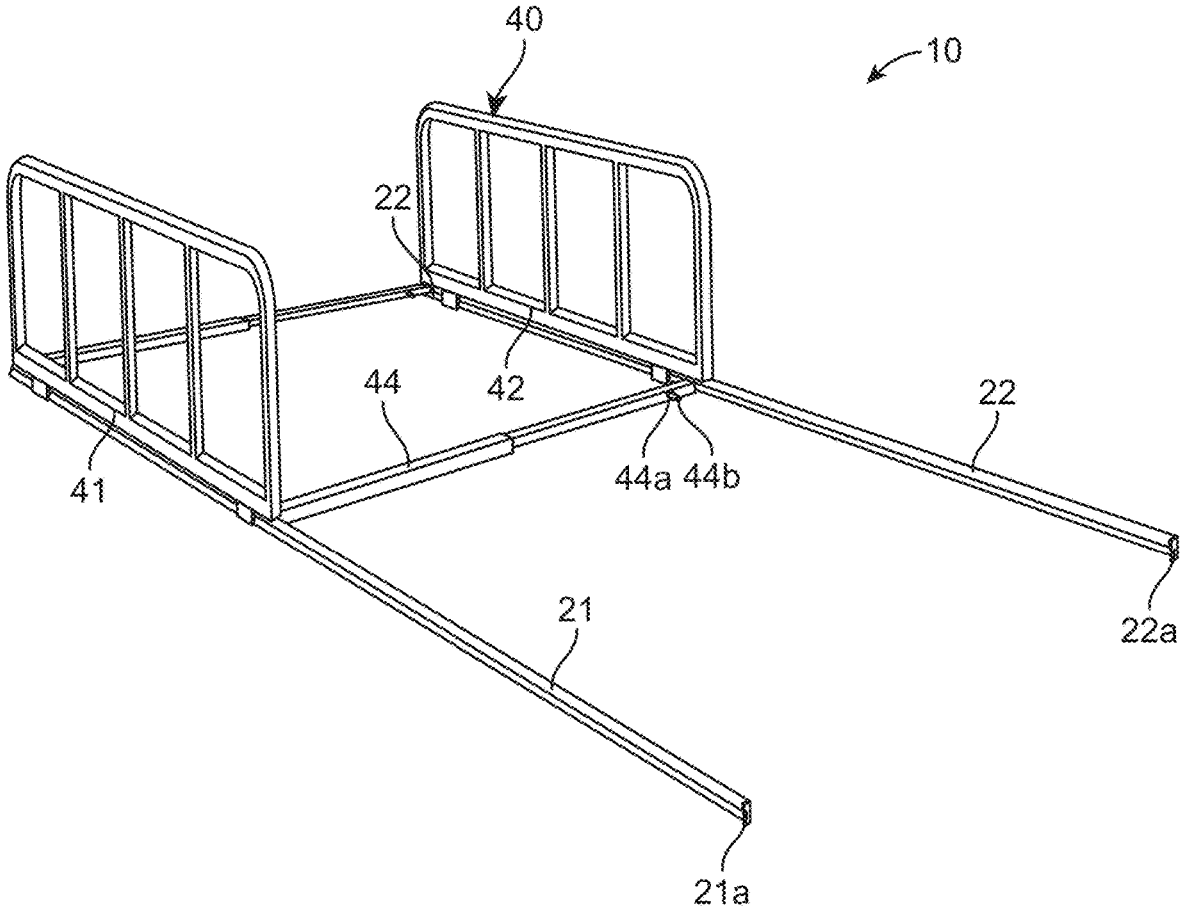
FIG. 2 shows an isometric view of the bedside assembly 40 slidably mounted to the rails assembly 20.
Figure 3:
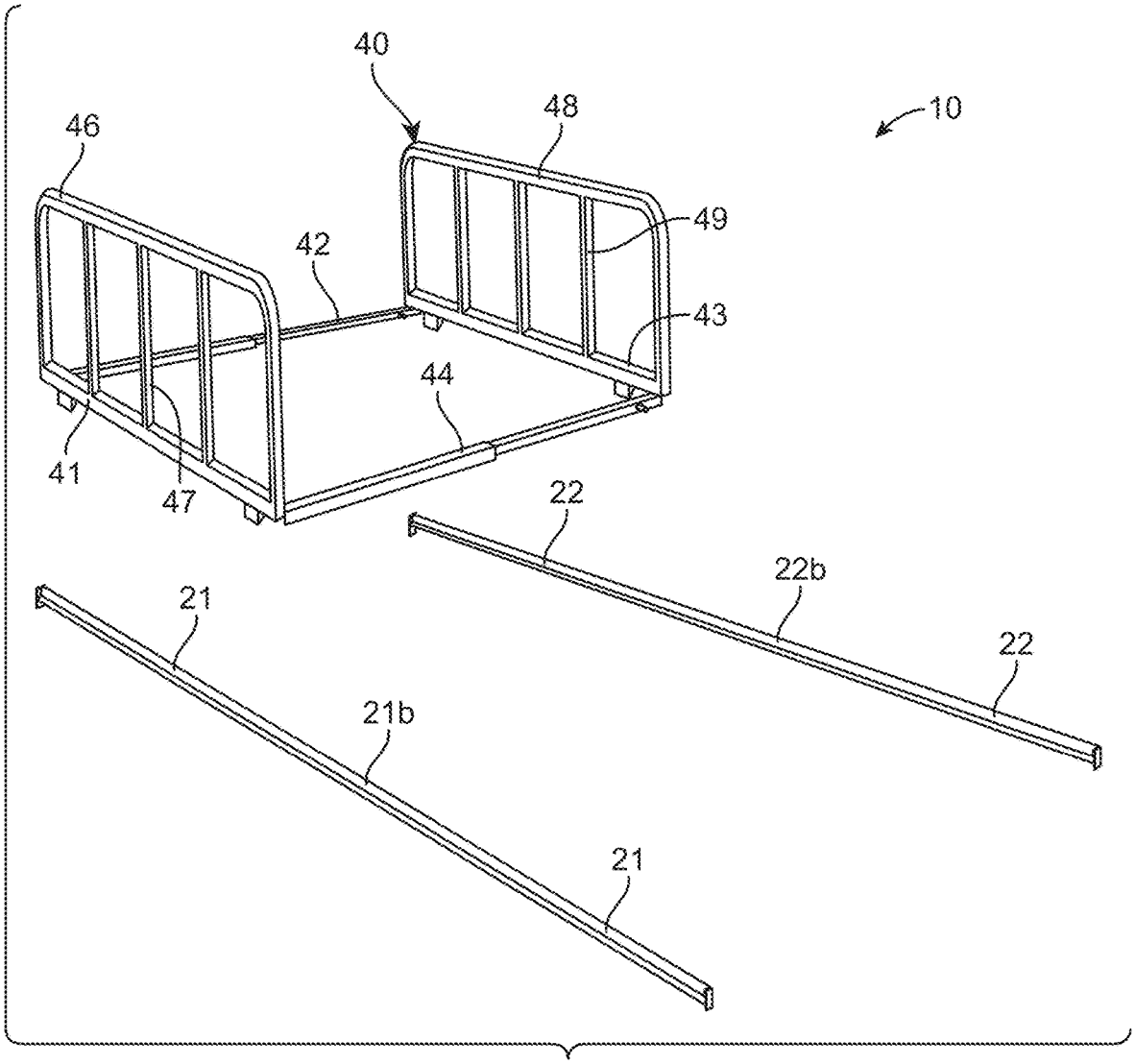
FIG. 3 illustrates an exploded view of the rails assembly 20 and bedside assembly 40.
Figure 4:
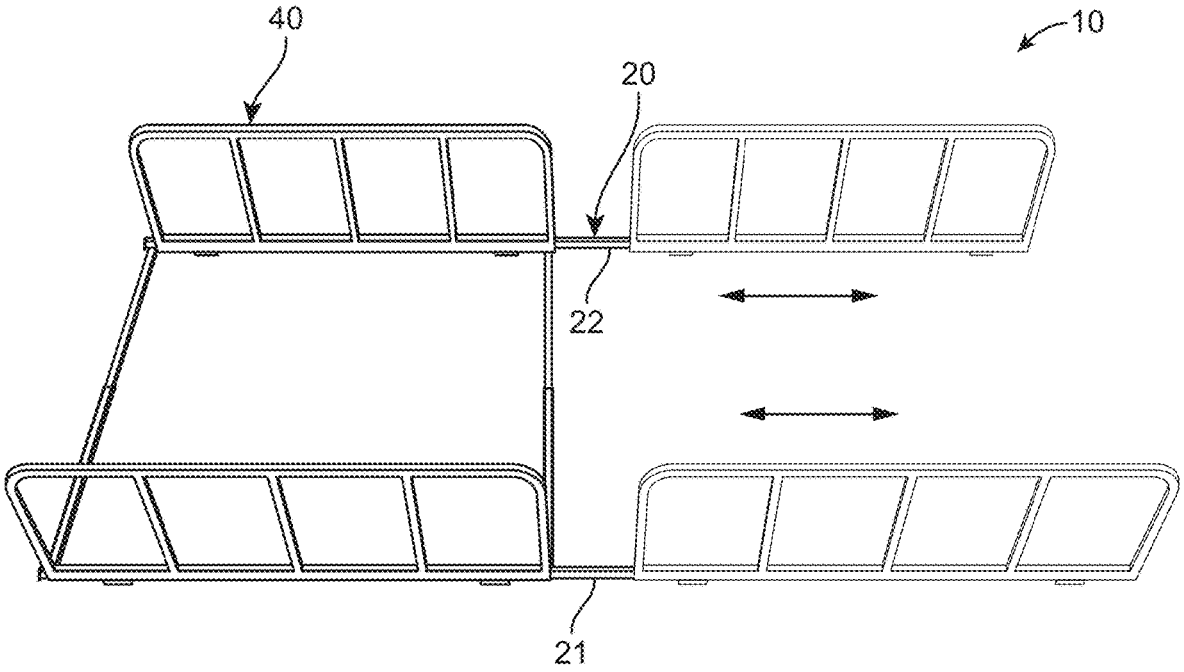
FIG. 4 is a representation of an isometric view of the present invention 10 showing the bedside assembly 40 sliding through the rails assembly 20.

Referring now to the drawings, where the present invention is generally referred to with numeral 10, it can be observed that it basically includes a rails assembly 20 and a bedside assembly 40. It should be understood there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

The rails assembly 20 may include first rail 21 and second rail 22. The first rail 21 and second rail 22 may be elongated rails. The first rail 21 and second rail 22 may be any suitable type of rail that allows the bedside assembly 40 to slide therein. The first rail 21 and second rail 22 may have a square profile. It also may be suitable to have the first rail 21 and the second rail 22 with other suitable profile shapes. The first rail 21 and second rail 22 may be made of a metal such as aluminum. It also may be suitable to have the first rail 21 and second rail 22 made of other materials. The first rail 21 may have an end with a first flap 21*a* for griping to a bed box spring 100. The second rail 22 may have an end with a second flap 22*a* to grip a bed box spring 100. The first rail 21 may have a first pivot 21*b* that allows the first rail 21 to rotate 180 degrees down and out the way when needed. The second pivot 22*b* may be located on a middle portion of the first rail 21. The second rail 22 may have a second pivot 22*b* to rotate the second rail 22 down and out when needed. The second pivot 22*b* may be located on a middle portion of the second rail 22.

The bedside assembly 40 may include a first bedrail 46 and a second bedrail 48. The first bedrail 46 may have a rectangular shape with top rounded corners. The first bedrail 46 may be ergonomic. The first bedrail 46 may have a first horizontal bar 41 and a plurality of vertical bars 47. The first horizontal bar 41 may be located at a bottom portion of the first bedrail 46. The first horizontal bar 41 may be slidably attached to the first rail 21 allowing the first bedrail 46 to slide through the first rail 21. The vertical bars 47 may be located perpendicular to the first horizontal bar 41. The first bedrail 46 may be made of metal or any other suitable material. The second bedrail 48 may have a rectangular shape with top rounded corners. The second bedrail 48 may have a second horizontal bar 43 and vertical bars 49. The second horizontal bar 43 may be attached to a bottom portion of the second bedrail 48. The second horizontal bar 43 may be slidably attached to the second rail 22 allowing the second bedrail 48 to slide theretrough. The second bedrail 48 may be made of a metal or any other suitable material.

Figure 5:
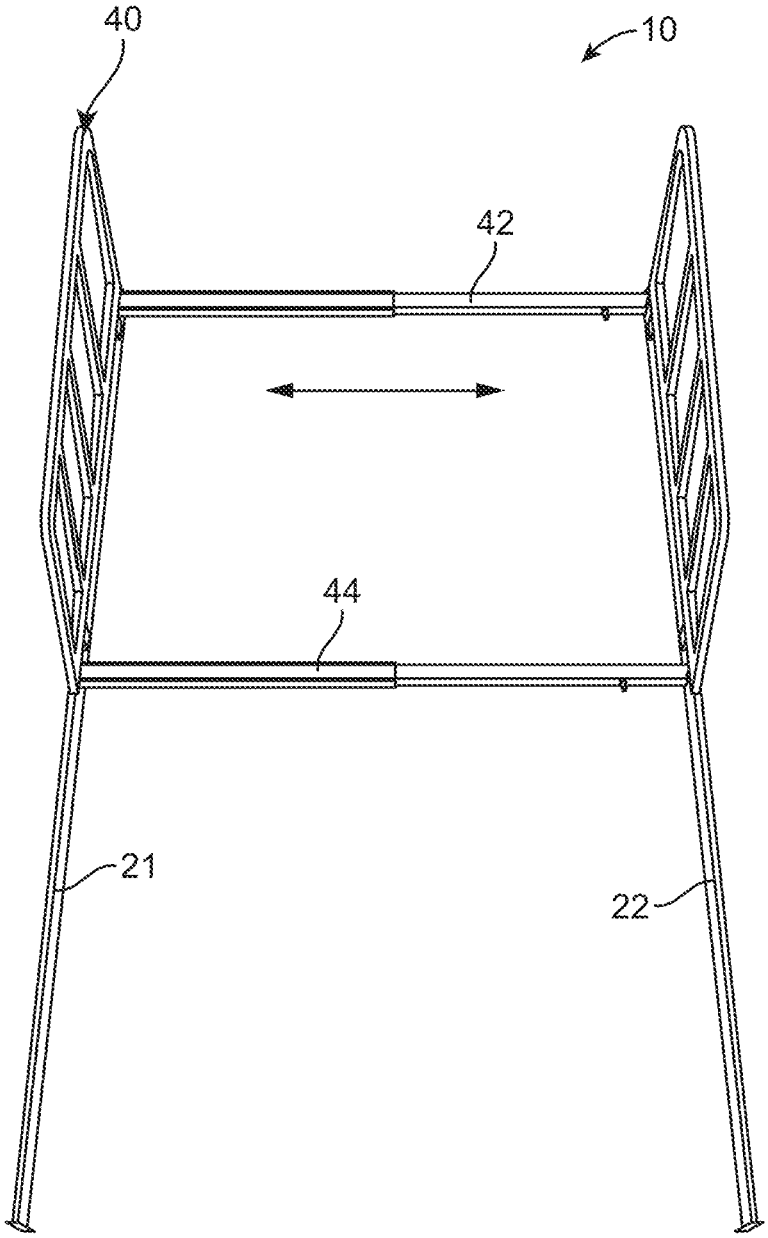
FIG. 5 shows a top front view of the present invention 10 in a twin configuration.
Figure 6:
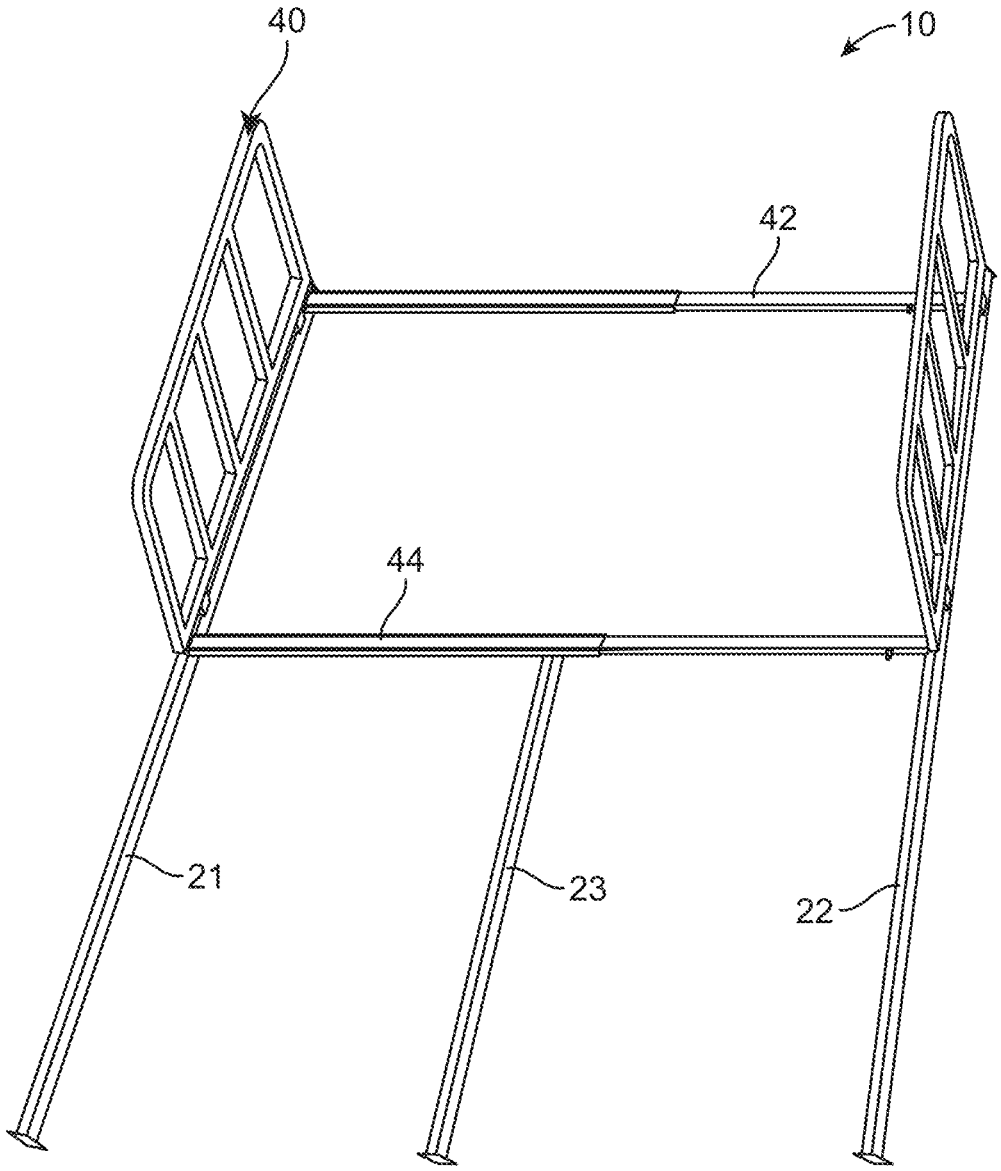
FIG. 6 illustrates an isometric view of the present invention 10 in a full bed configuration.
Figure 7:
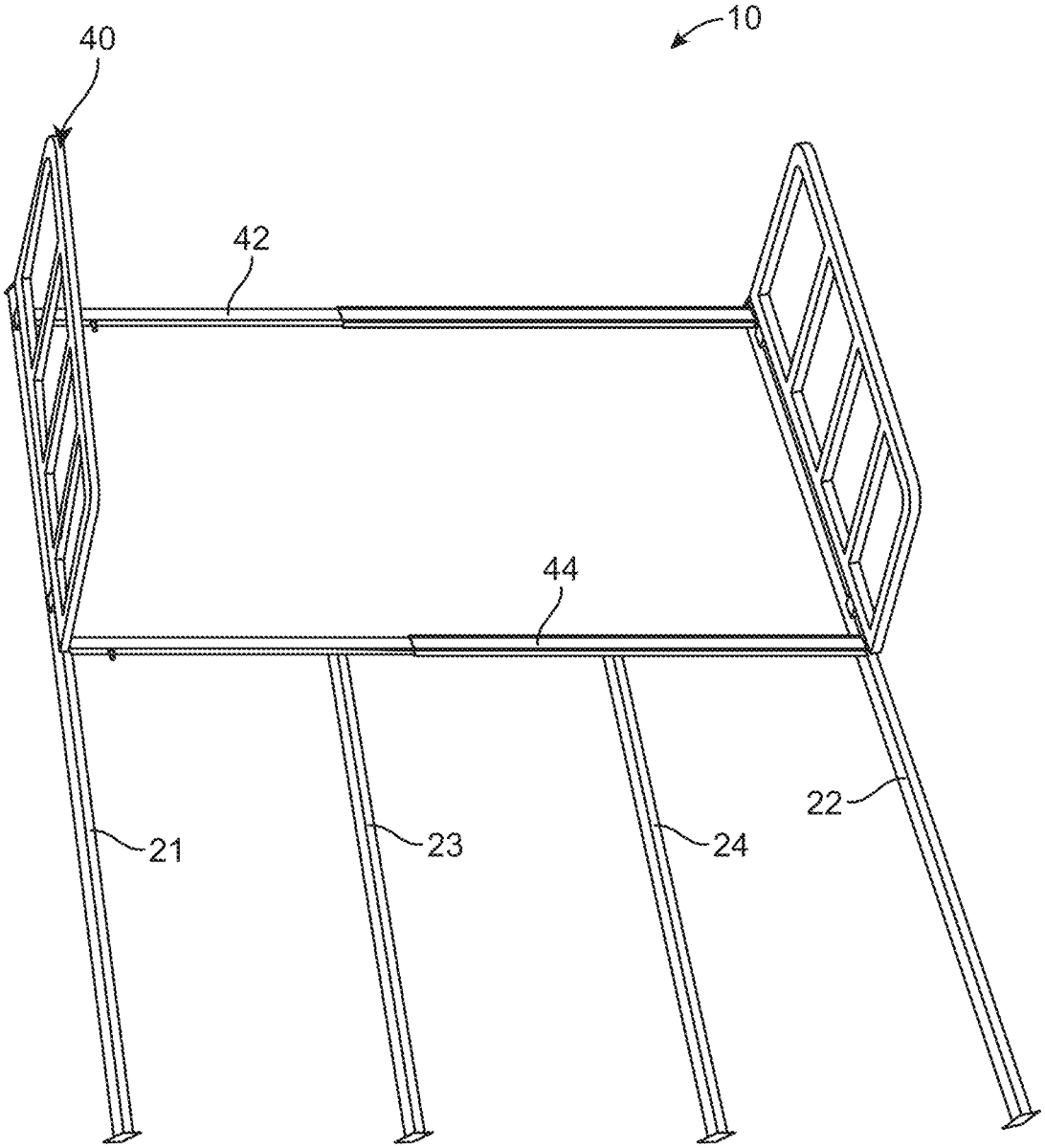
FIG. 7 depicts an isometric view of the present invention 10 in a queen bed configuration.

The bedside assembly 40 may further include a first beam 42 and a second beam 44. A first end of the first beam 42 may be connected to a first end of the first horizontal bar 41. A first end of the second beam 44 may be connected to a second end of the first horizontal bar 41. A second end of the first beam 42 may be connected to a first end of the second horizontal bar 43. A second end of the second beam 44 may be connected to a second end of the second horizontal bar 43. The first beam 42 and the second beam 44 may be telescopic beams. The first beam 42 and second beam 44 may be length adjustable beams. The first beam 42 and the second beam 44 may have locking pins and pin holes. In one embodiment, the pin holes may be located at 49 inches, 54 inches, and 72 inches of the first beam 42 and second beam 44. The first beam 42 and second beam 44 may be telescopically expanded to allow different lengths of the bedside assembly 40 for different mattress sizes. For example, the first beam 42 and second beam 44 may be in a single configuration as observed in FIG. 5, where the bedside assembly 40 is configured to fit in a single mattress. The first beam 42 and second beam 44 may be expanded to fit a twin mattress as observed in FIG. 6. The twin mattress configuration may include a beam 23 secured to the second beam 44 for additional support. The first beam 42 and the second beam 44 may be expanded to a queen mattress size configuration as observed in FIG. 7. The queen size mattress configuration may include the beam 23 and beam 24. It should be understood that the bedside assembly 40 may include additional beams and that the first beam 42 and second beam 44 may be retracted or expanded to fit in any suitable mattress. The beams may be positioned under a mattress 101 near the head and foot of the bed.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A universal bed side rail, comprising:

a) a bedside assembly including a first bedrail and a second bedrail mounted on two opposing sides of a mattress, wherein the first bedrail and the second bedrail are secured to length adjustable beams, said length adjustable beams are positioned under said mattress near a head and a foot of the bed, wherein the length adjustable beams include holes and pins to secure support beams therein, wherein the support beams are perpendicular to the length adjustable beams; a rails assembly including a first rail and a second rail, wherein the first rail includes a first pivot that allows the first rail to rotate, said first pivot is located on a middle portion of the first rail, wherein the second rail includes a second pivot that allows the second rail to rotate, said second pivot is located on a middle portion of the second rail, wherein the first rail has a first flap located at a first end of the first rail, said first flap secures to a box spring, wherein the second rail has a second flap located at a first end of the second rail, said second flap secures to the box spring.

2. The universal bed side rail from claim 1, wherein the first bedrail is slidably secured to the first rail, wherein the second bedrail is slidably secured to the second rail.

3. The universal bed side rail from claim 1, wherein the first bedrail and the second bedrail include vertical bars thereon.

4. The universal bed side rail from claim 1, wherein said first rail and said second rail rotate when needed.

5. A universal bed side rail assembly, comprising:

a) a mattress including a spring box;

b) a bedside assembly including a first bedrail and a second bedrail mounted on two opposing sides of the mattress, wherein the first bedrail and the second bedrail are secured to length adjustable beams, said length adjustable beams are positioned under said mattress near a head and a foot of the bed, wherein the length adjustable beams include holes and pins to secure support beams therein, wherein the support beams are perpendicular to the length adjustable beams; and c) a rails assembly including a first rail and a second rail, wherein the first bedrail is slidably secured to the first rail, wherein the second bedrail is slidably secured to the second rail, wherein the first rail has a first flap located at a first end of the first rail, said first flap secures to the box spring, the second rail has a second flap located at a first end of the second rail, said second flap secures to the box spring, wherein the first rail includes a first pivot that allows the first rail to rotate, said first pivot is located on a middle portion of the first rail, wherein the second rail includes a second pivot that allows the second rail to rotate, said second pivot is located on a middle portion of the second rail.

6. A universal bed side rail assembly, consisting of:

a) a mattress including a spring box;

b) a bedside assembly including a first bedrail and a second bedrail mounted on two opposing sides of the mattress, wherein the first bedrail and the second bedrail are secured to length adjustable beams, said length adjustable beams are positioned under said mattress near a head and a foot of the bed, wherein the length adjustable beams include holes and pins to secure support beams therein, wherein the support beams are perpendicular to the length adjustable beams; and c) a rails assembly including a first rail and a second rail, wherein the first bedrail is slidably secured to the first rail, wherein the second bedrail is slidably secured to the second rail, wherein the first rail has a first flap located at a first end of the first rail, said first flap secures to the box spring, the second rail has a second flap located at a first end of the second rail, said second flap secures to the box spring, wherein the first rail includes a first pivot that allows the first rail to rotate, said first pivot is located on a middle portion of the first rail, wherein the second rail includes a second pivot that allows the second rail to rotate, said second pivot is located on a middle portion of the second rail.

* * * * *